US006698744B2

(12) United States Patent
Yamada et al.

(10) Patent No.: US 6,698,744 B2
(45) Date of Patent: Mar. 2, 2004

(54) SHEET FINISHER FOR AN IMAGE FORMING APPARATUS

(75) Inventors: Kenji Yamada, Tokyo (JP); Shinji Asami, Saitama (JP); Nobuyoshi Suzuki, Tokyo (JP); Hiromoto Saitoh, Kanagawa (JP); Takeshi Sasaki, Tokyo (JP); Hiroki Okada, Kanagawa (JP); Junici Iida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 47 days.

(21) Appl. No.: 10/118,956

(22) Filed: Apr. 10, 2002

(65) Prior Publication Data

US 2002/0163120 A1 Nov. 7, 2002

(30) Foreign Application Priority Data

Apr. 11, 2001 (JP) ..... 2001-112815
Mar. 26, 2002 (JP) ..... 2002-086718

(51) Int. Cl.[7] ..... B65H 39/02

(52) U.S. Cl. ..... 270/58.12; 270/58.08; 271/221; 399/410

(58) Field of Search ..... 271/221; 270/58.08, 270/58.11, 58.12, 58.13; 399/410

(56) References Cited

U.S. PATENT DOCUMENTS 5,072,920 A 12/1991 Kubota et al.
5,121,911 A * 6/1992 Yamazaki et al. ..... 270/58.13
5,263,697 A * 11/1993 Yamazaki et al. ..... 270/58.08
5,508,798 A 4/1996 Yamada
5,622,359 A 4/1997 Kawano et al.
5,634,634 A * 6/1997 Dobbertin et al. ..... 271/3.02
5,692,411 A 12/1997 Tamura
5,762,328 A * 6/1998 Yamada et al. ..... 270/58.08
6,145,825 A 11/2000 Kunihiro et al.
6,199,853 B1 3/2001 Andoh et al.
6,231,045 B1 5/2001 Yamada et al.
6,264,191 B1 7/2001 Suzuki et al.
6,296,247 B1 * 10/2001 Tamura et al. ..... 271/214
6,322,070 B2 11/2001 Yamada et al.
6,343,785 B1 2/2002 Yamada et al.
6,382,616 B1 * 5/2002 Waragai et al. ..... 270/58.12
6,394,448 B2 5/2002 Suzuki et al.
6,416,052 B2 7/2002 Yamada et al.
6,494,449 B2 12/2002 Tamura et al.
6,494,453 B1 12/2002 Yamada et al.

FOREIGN PATENT DOCUMENTS

JP 2000-191219 7/2000

* cited by examiner

*Primary Examiner*—Patrick Mackey
(74) *Attorney, Agent, or Firm*—Oblon, Spivak, McClelland, Maier & Neustadt, P.C.

(57) ABSTRACT

A sheet finisher of the present invention includes jogger fences for jogging sheets sequentially stacked in a stapling section, and a stapler for stapling the sheets together. A CPU (Central Processing Unit) controls a jogger motor such that the jogger fences each move to a first position, a second position, and a third position in accordance with the width of sheets in a direction perpendicular to the direction of sheet conveyance. The first position is remote from the edge of a sheet stack in the direction of the width by a preselected amount. The second position is closer to the edge than the first position by a preselected amount and slightly overlaps the edge. At the third position, when the stapler staples the sheet stack, the jogger fence substantially contacts the edge in accordance with the width.

36 Claims, 10 Drawing Sheets

SHEET FINISHER FOR AN IMAGE FORMING APPARATUS

BACKGROUND OF THE INVENTION

1. Field of the Invention

The present invention relates to a copier, printer, facsimile apparatus or similar image forming apparatus and more particularly to a sheet finisher operatively connected to the image forming apparatus for executing preselected processing with sheets.

2. Description of the Background Art

A sheet finisher is proposed in various forms in the past and capable of stapling, punching or otherwise processing sheets sequentially driven out of an image forming apparatus. The prerequisite with a sheet finisher of the type jogging sheets one by one and then stapling them together is the accuracy of jogging. Various methods have heretofore been proposed for meeting such a prerequisite.

It is a common practice to jog sheets with a pair of jogger fences or similar jogging members. Many of conventional jogging members address to accurate jogging at or around the allowable limit of the number of sheets that can be dealt with by, e.g., a stapler. Many users, however, daily deal with a stack of ten sheets or less to be stapled together and rarely deals with a stack of fifty sheets or more, as known by experiment and proved by the results of various market researches. More specifically, accurate jogging of a small number of sheets impresses users favorably.

Generally, jogging of sheets becomes more difficult as the number of sheets to be stapled together increases. In light of this, the jogging members are moved toward each other to a distance slightly smaller than the width of sheets, thereby pressing the edges of a sheet stack. This kind of scheme is desirable when the number of sheets is small. However, as the number of sheets sequentially stacked increases, it becomes difficult for the sheets to move. This, coupled with an increase in the reaction of the sheets acting on the jogging members, causes not only the jogging members but also parts for driving them to bend, obstructing accurate jogging.

Another advantage achievable with the jogging members pressing a sheet stack, as stated above, is that they absorb irregularity in sheet width and loosens sheets being stacked for thereby enhancing accurate jogging.

Japanese Patent No. 2,960,770 teaches a sheet finisher of the type described. After the last sheet has been stacked and jogged, the sheet finisher taught in the above document causes jogging means to again move in order to press the sheet stack during stapling. With this configuration, the sheet finisher prevents the jogged sheets from moving during stapling. The sheet finisher, however, presses the sheet stack by the same amount during stapling as during jogging. This is because the sheet finisher addresses to accurate jogging at or around the allowable limit of the number of sheets, as stated above, and directed only toward the simplification of software.

When a large number of sheets are to be stapled, the jogging means taught in the above document again moves after the last jogging movement so as to press the sheets during stapling. This desirably maintains the sheets in the accurately jogged position even during stapling. However, when the number of sheets to be stapled together is small, the sheets are loosened and therefore bent. As a result, the sheets stacked together are apt to shift in the lengthwise direction, which is perpendicular to the direction in which the jogging means moves.

Technologies relating to the present invention are also disclosed in, e.g., Japanese Patent Laid-Open Publication No. 2000-191219.

SUMMARY OF THE INVENTION

It is an object of the present invention to provide a sheet finisher for an image forming apparatus capable of accurately jogging sheets without regard to the number of sheets.

In accordance with the present invention, a sheet finisher includes a stacking section for stacking sheets thereon, a jogging device for jogging the sheets sequentially stacked on the stacking section one by one, and a processing device for executing preselected processing with the sheets. The jogging device includes a pair of jogging members for jogging the sheets one by one, and a controller for controlling the jogging members. The controller moves, in accordance with the width of the sheets in a direction perpendicular to the direction of sheet conveyance, each jogging member to a first position remote from one edge of the sheets in the direction of width by a preselected amount, a second position closer to the edge than the first position by a preselected amount and slightly overlapping the edge, and a third position where, when the processing device executes the preselected processing, the jogging member substantially contacts the edge in accordance with the width. Assuming that the jogging members are spaced from each other by a distance of L2 at the second position or by a distance of L3 at the third position, the controller sets at least one of the distances L2 and L3 in accordance with the width or the number of the sheets.

An image forming system including the above sheet finisher and an image forming apparatus are also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1A:
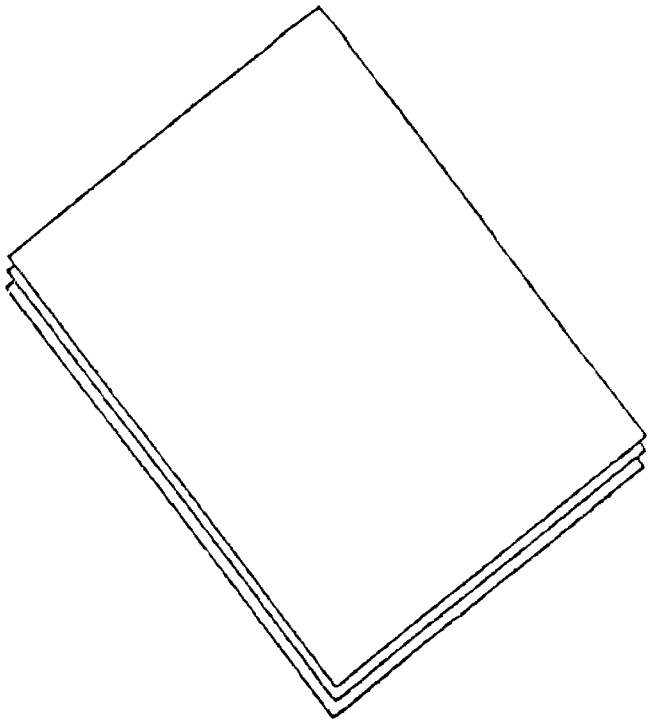
FIG. 1A PRIOR ART
FIG. 1A shows a stack of sheets in a jogged state.

To better understand the present invention, the problem with the sheet finisher taught in Japanese Patent No. 2,960, 770 mentioned earlier will be described more specifically with reference to FIGS. 1A and 1B. In the event of stapling a large number of sheets, the jogging means included in the finisher again moves after the last jogging movement so as to press the sheets during stapling. This desirably enhances accurate jogging during stapling, as stated earlier. However, when the number of sheets to be stapled together is small, the sheets are loosened and therefore bent. As a result, the sheets stacked together are apt to shift in the lengthwise direction, which is perpendicular to the direction in which the jogging means moves.

Figure 1B:
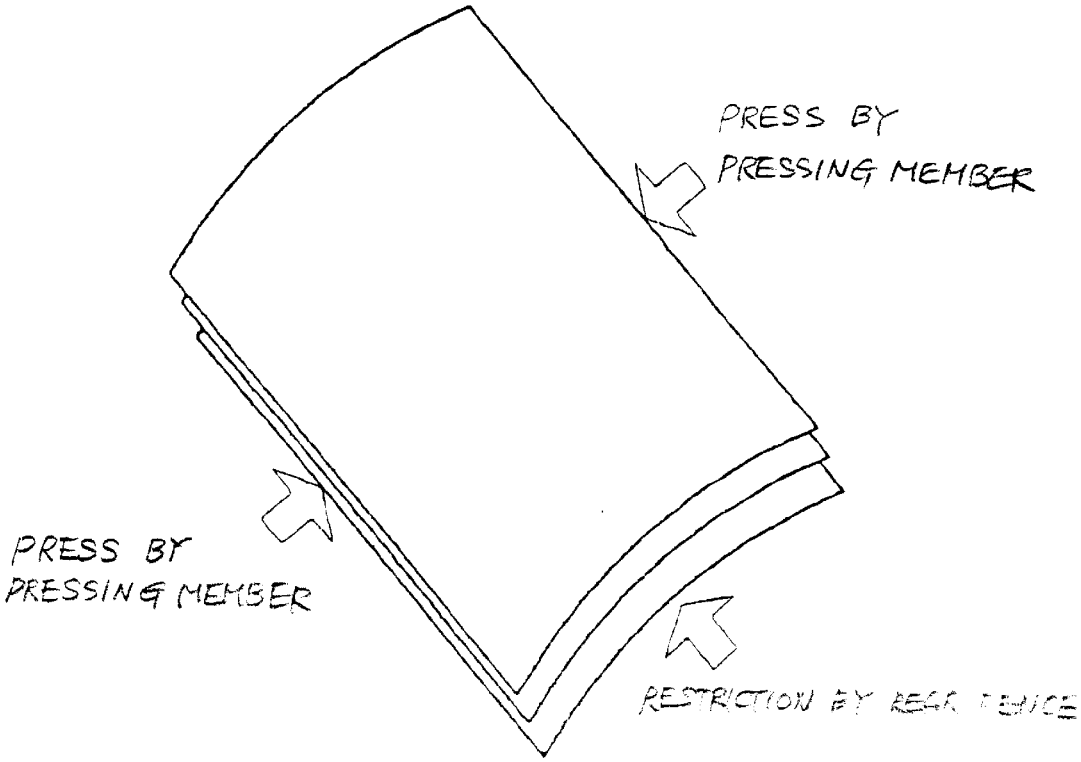
FIG. 1B PRIOR ART
FIG. 1B demonstrates how the sheet stack bends when pressed by pressing members.

More specifically, FIG. 1 shows a stack of sheets accurately jogged by pressing members included in the jogging means. As shown in FIG. 1B, when the pressing members are fed toward such a jogged sheet stack by an excessive amount, the sheet stack bends in a semicylindrical cross-section. Further, the sheets tend to move away from a staple stray (upward in FIG. 1B) because they are restricted by the pressing members at the side edges and restricted by a rear fence at the rear edge. Moreover, if the amount by which the pressing members press the sheet stack is constant, then the ratio of the amount to width varies in accordance with sheet size, effecting the influence on jogging accuracy.

Figure 2:
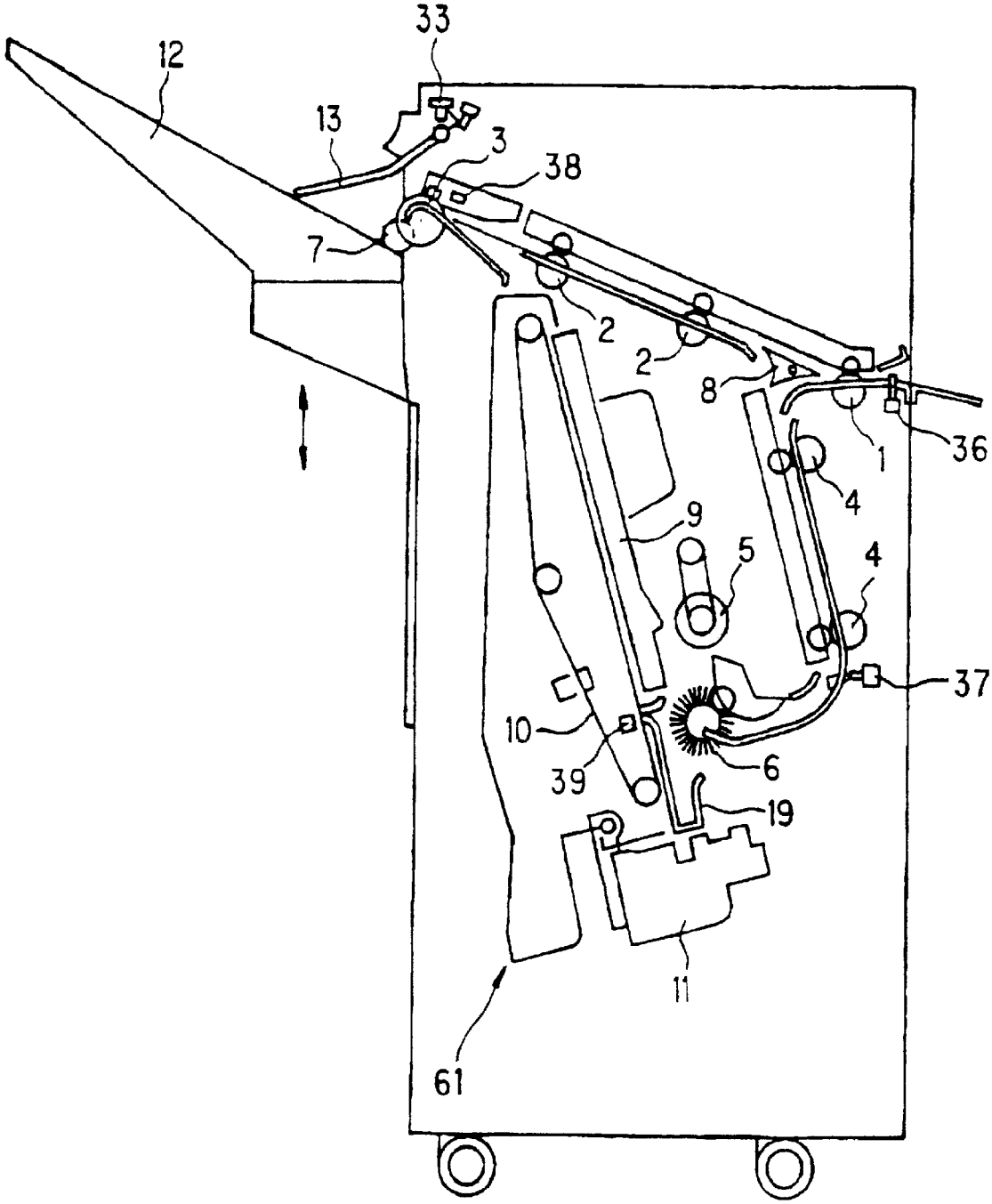
FIG. 2 shows a sheet finisher embodying the present invention.

Referring to FIG. 2, a finisher embodying the present invention is shown and operatively connected to a copier or similar image forming apparatus not shown. As shown, the finisher includes a sheet inlet for receiving sheets sequentially driven out of the copier. An inlet sensor 36 and an inlet roller 1 adjoin the sheet inlet. The inlet sensor 36 senses a sheet entering the finisher via the sheet inlet while the inlet roller 1 conveys the sheet into the finisher. A path selector 8 steers the sheet toward either one of a copy tray 12 and a stapler 11.

Upper rollers 2 are positioned on the path extending from the path selector 8 toward the copy tray 12 so as to convey the sheet toward the tray 12. An outlet sensor 38 is responsive to the sheet being conveyed by the upper rollers 2. An outlet roller 3 drives the sheet out of the finisher to the copy tray 12. A push roller 7 pushes the sheet driven out to the copy tray 12 to a preselected position. A lever 13 senses the sheet present on the copy tray 12. A sheet level sensor 13 senses the angular position of the lever 13. An elevation motor 51 (see FIG. 7) selectively moves the copy tray 12 upward or downward. Also, a shift motor 52 (see FIG. 7) moves the copy tray 12 in the direction perpendicular to the direction of sheet conveyance, as needed.

Lower rollers 4 are positioned on the path extending from the path selector 8 toward the stapler 11 so as to convey the sheet toward the stapler 11. A sheet sensor 37 senses the sheet being conveyed by the lower rollers 4. A brush roller or feed roller 6 conveys the sheet moved away from the sheet sensor 37 into the stapler 11. A conveyance motor 54 (see FIG. 7) drives the lower rollers 4.

The stapler 11 is positioned at the bottom of a stapling section 61 and driven by a staple motor 56 (see FIG. 7), which will be described later. The stapling section 61 additionally includes jogger fences 9 (only one is visible), a return roller or hit roller 5, and a belt 10. The jogger fences 9 cooperate to jog the sheet driven onto a staple tray included in the stapling section 61. The belt 10 is positioned at the back of the jogger fences 9 for conveying a stapled sheet stack out of the stapling section 61. A belt home position sensor 39 adjoins the belt 10 and is responsive to the home position of the belt 10. A catch 10*a* (see FIG. 6) is positioned on the belt 10 for catching the sheet stack. The sheet sensor 37 is located at such a position that even when the return roller 5 is caused to act just after the sensor 37 has sensed the trailing edge of the sheet, the roller 5 can hit the trailing edge of the sheet.

Figure 3:
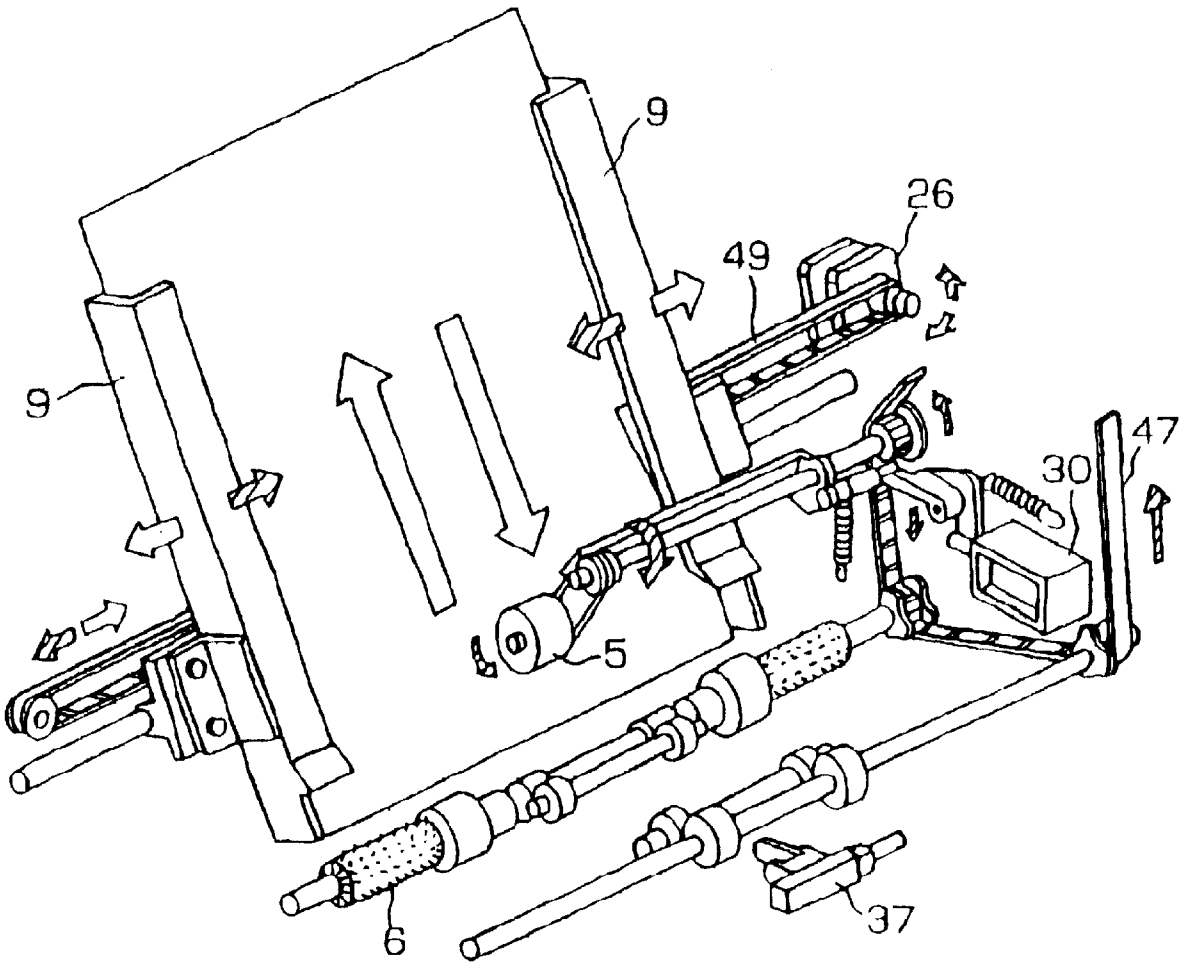
FIG. 3 is an isometric view showing a jogging mechanism included in the illustrative embodiment.
Figure 4:
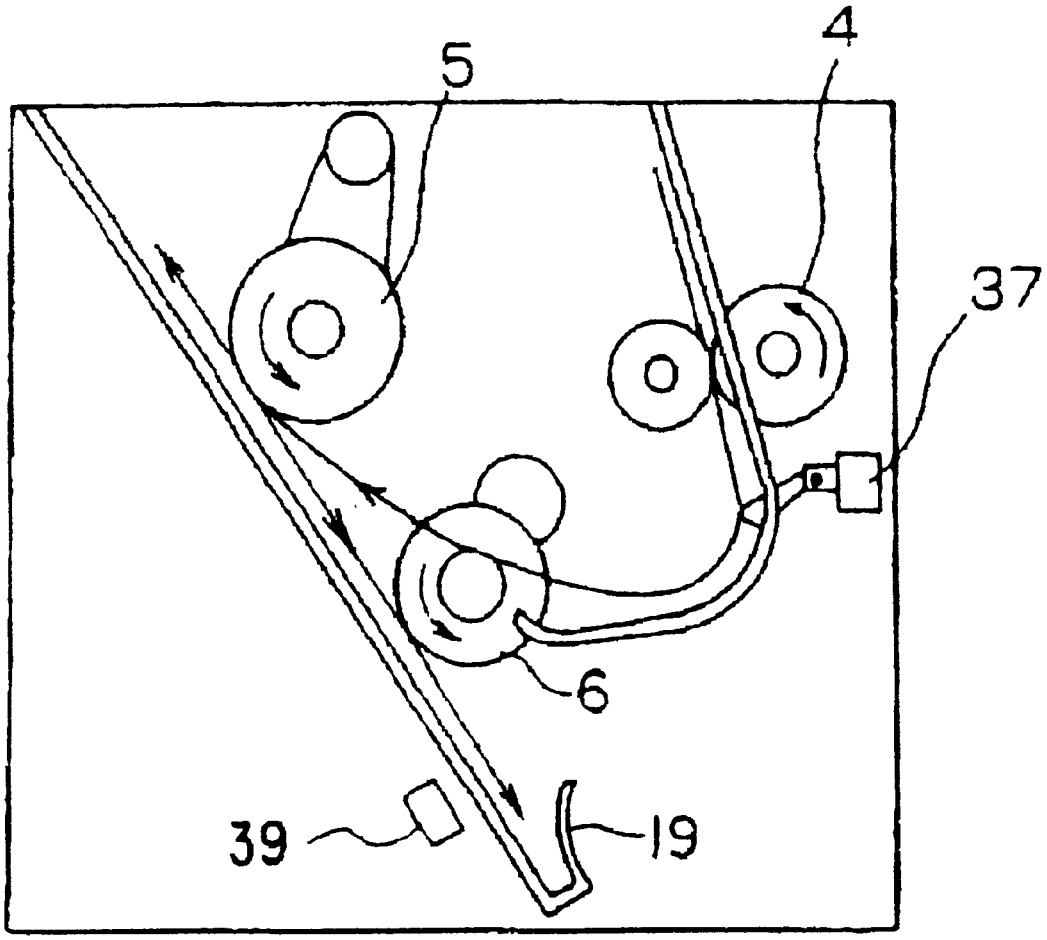
FIG. 4 is a fragmentary view showing a return roller and members around it.

More specifically, as shown in FIG. 3, a jogger motor 26 drives the jogger fences 9 via a belt 49. A solenoid 30 supports the return roller 5 such that the roller 5 can swing in a pendulum fashion. A belt 47 transmits the rotation of the conveyance motor 54 to one of rollers constituting each lower rollers 4 and feed roller 6. As shown in FIG. 4, a rear fence 19 is positioned below the jogger fences 9 such that the sheet abuts against the rear fence 19. More specifically, as shown in FIG. 5, a pair of rear fences 19 are positioned side by side.

Figure 5:
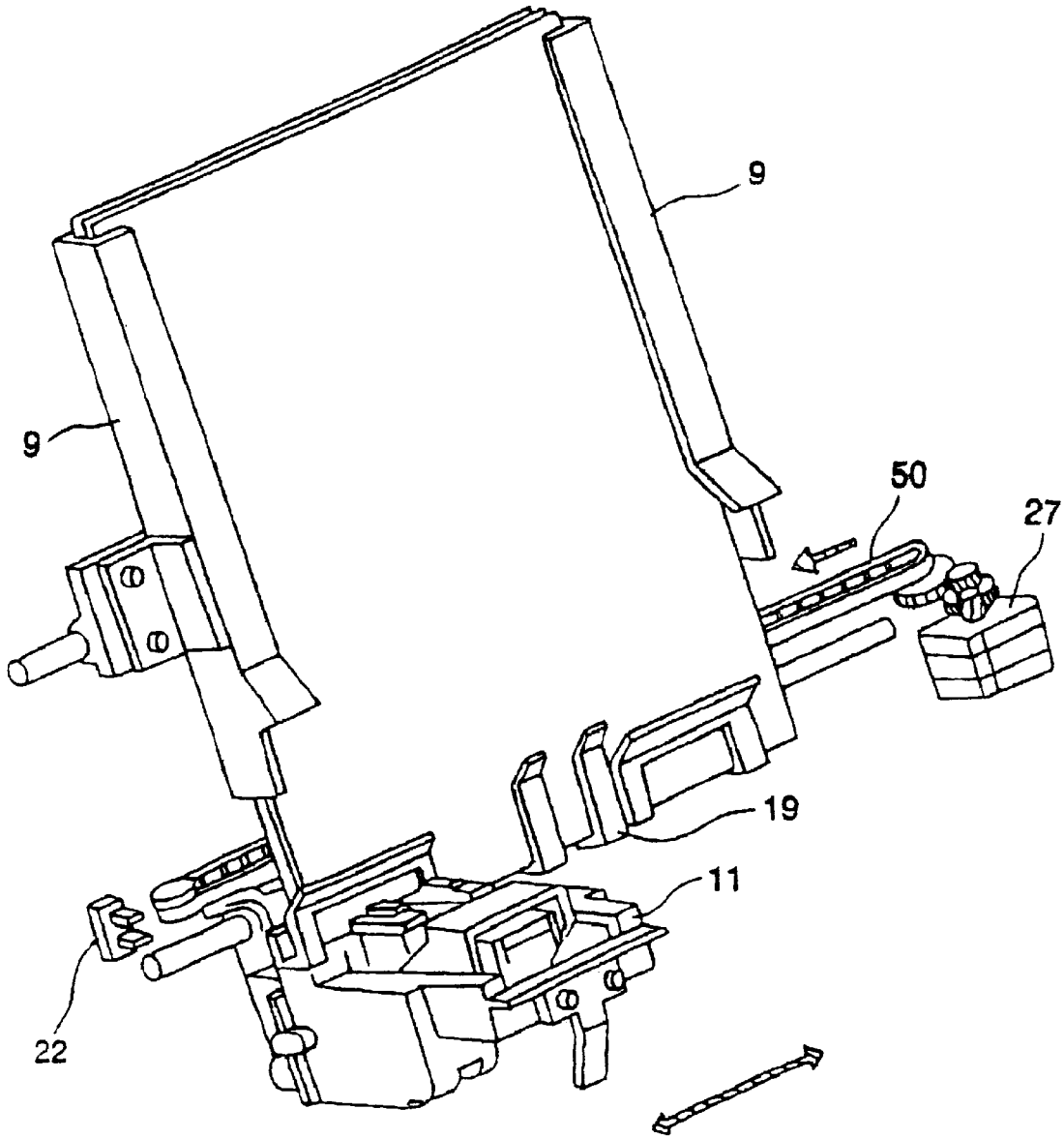
FIG. 5 is an isometric view showing a stapler also included in the illustrative embodiment.
Figure 6:
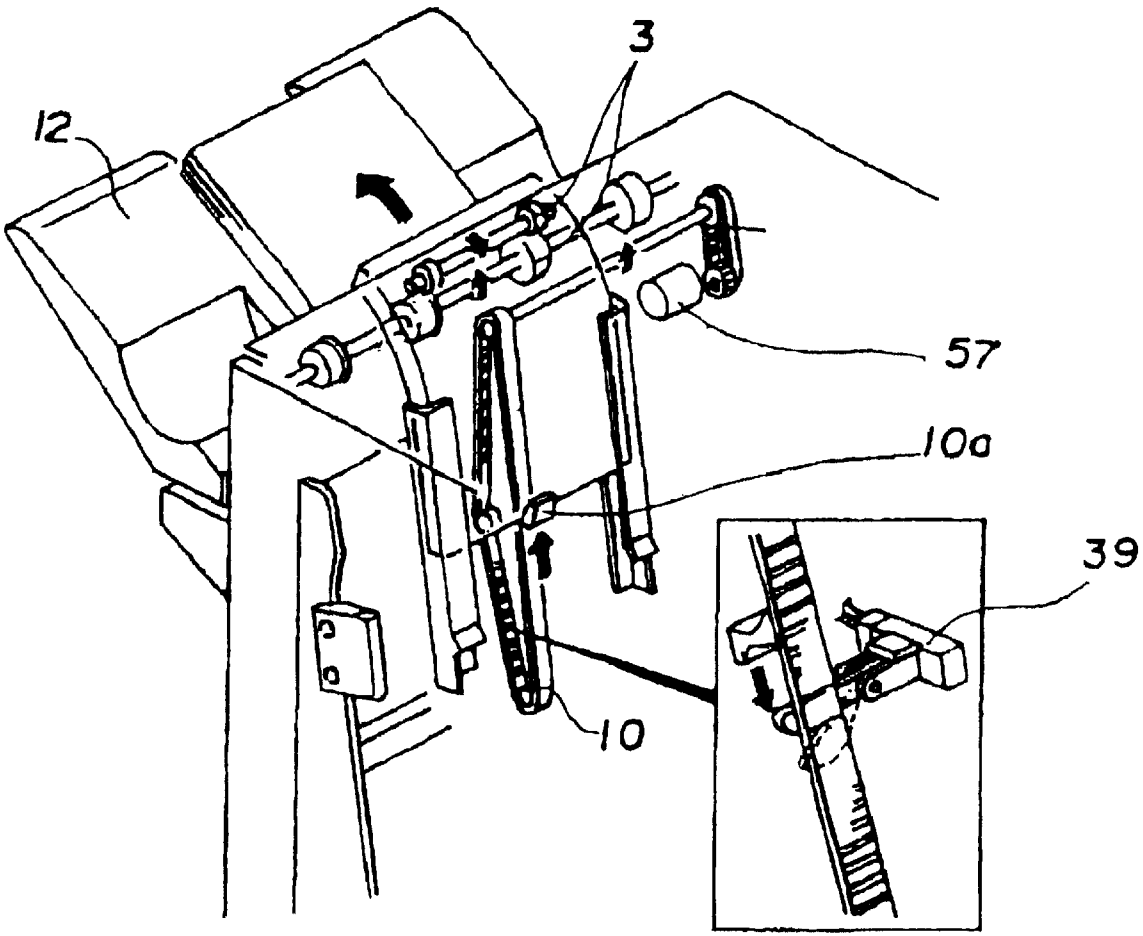
FIG. 6 is a fragmentary isometric view showing a copy tray further included in the illustrative embodiment and arrangements around it.

As shown in FIG. 5, a stapler motor 27 causes the stapler 11 to move via a belt 50 in a direction perpendicular to the direction of sheet conveyance, as indicated by a double-headed arrow. As shown in FIG. 6, belt motor 57 causes the belt 10 to turn in a direction indicated by an arrow. A stapler home position sensor 22 is responsive to the home position of the stapler 11.

Figure 7:
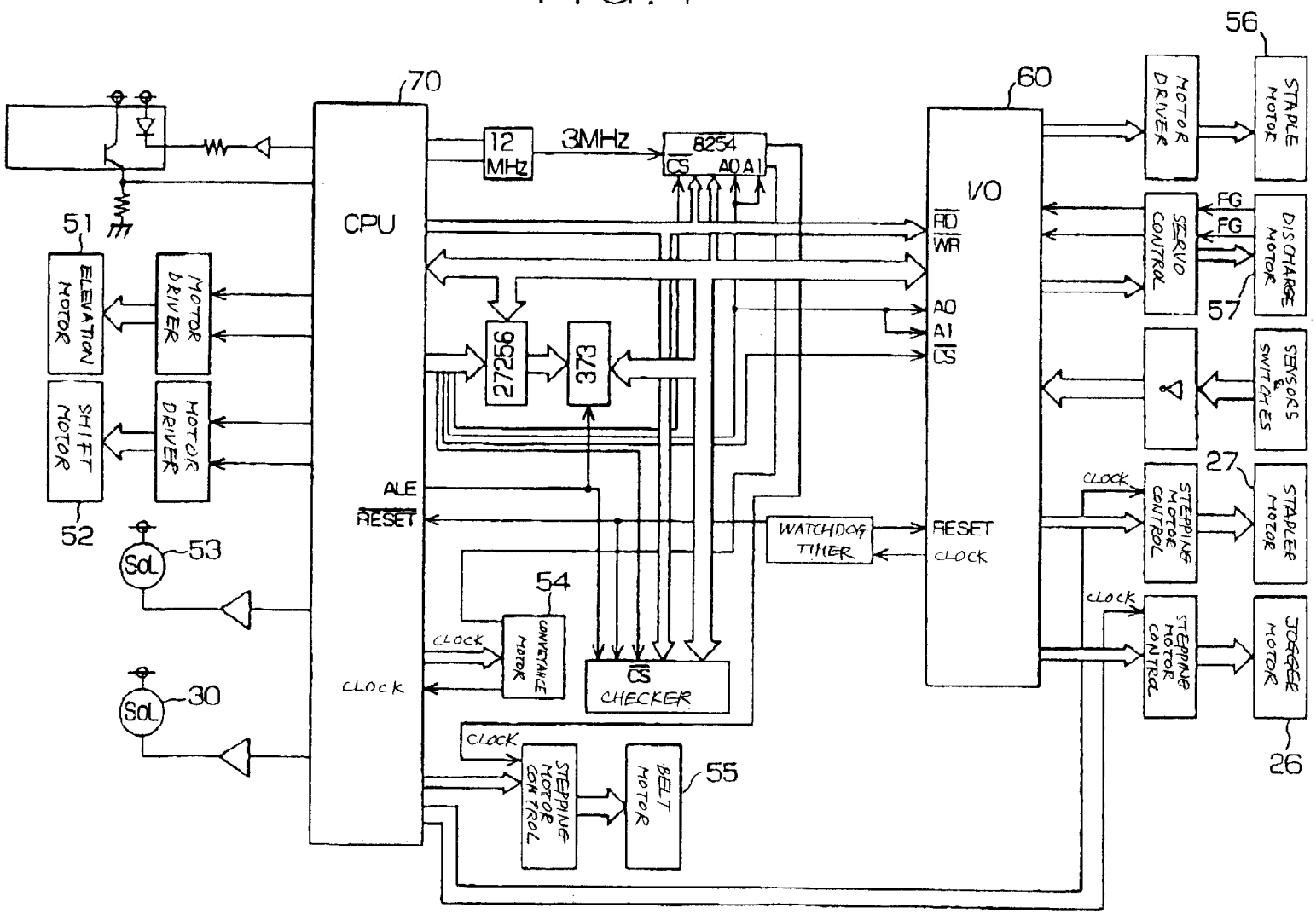
FIG. 7 is a schematic block diagram showing a control system of the illustrative embodiment.

FIG. 7 shows a control system included in the illustrative embodiment. As shown, the control system includes a CPU (Central Processing Unit) 70 implemented by, e.g., a microcomputer. Various switches and sensors arranged in the finisher send their outputs to the CPU 70 via an I/O (Input/Output) interface 60. The CPU 70 controls the conveyance motor 54 assigned to the inlet roller 1, upper rollers 2, lower rollers 4 and return roller 5, a discharge motor 55 assigned to the outlet roller 3 and push roller 7, the jogger motor 26 assigned to the jogger fences 9, the stapler motor 27 assigned to the stapler 11, and the belt motor 57 assigned to the belt 10 in accordance with the outputs of the switches and sensors. Such motors all are implemented as stepping motors.

Further, the CPU 70 controls, based on the outputs of the switches and sensors, a tray up-down motor 51 and a shift motor 52 that are assigned to the copy tray 12 as well as the staple motor 56. The motors 51, 52 and 56 are not stepping motors. In addition, the CPU 70 sends a control signal to a solenoid 53 that actuates the path selector 8. Counting pulses output from the conveyance motor 54, the CPU 70 controls a solenoid 30 assigned to the return roller 5 in accordance with the number of input pulses. The CPU 70 constitutes positioning control means together with various operation programs for operating the CPU 70.

The operation of the illustrative embodiment will be described hereinafter. First, assume that the operator of the copier selects a non-staple mode. Then, the solenoid 53 switches the position of the path selector 8 for steering sheets toward the upper rollers 2. In this condition, the inlet roller 1 drives a sheet or copy driven out of the copier to the upper rollers 2 via the path selector 8. The sheet is then sequentially driven by the upper rollers 2 and outlet roller 3 to the copy tray 12. The push roller 7 positions the sheet to be stacked on the copy tray 12 in the direction of sheet conveyance. At this instant, as soon as the sheet sensor 38 senses the trailing edge of the sheet, the push roller 7 is decelerated in order to enhance accurate stacking. As sheets are sequentially stacked on the copy tray 12, the top of the sheet stack raises one end of the lever 13. When the sheet level sensor 33 senses the other end of the lever 13, the tray up-down motor 51 is driven to lower the copy tray 12 by a preselected amount. As a result, the top of the sheet stack on the copy tray 12 is held at an adequate level at all times.

Assume that the operator selects a sort mode or a stack mode on a control panel mounted on the copier. Then, the shift motor 52 repeatedly shifts the copy tray 12 in the direction perpendicular to the direction of sheet conveyance, thereby sorting or stacking consecutive sheets until the job ends. At the end of the job, the copy tray 12 is lowered by about 30 mm.

Figure 9:
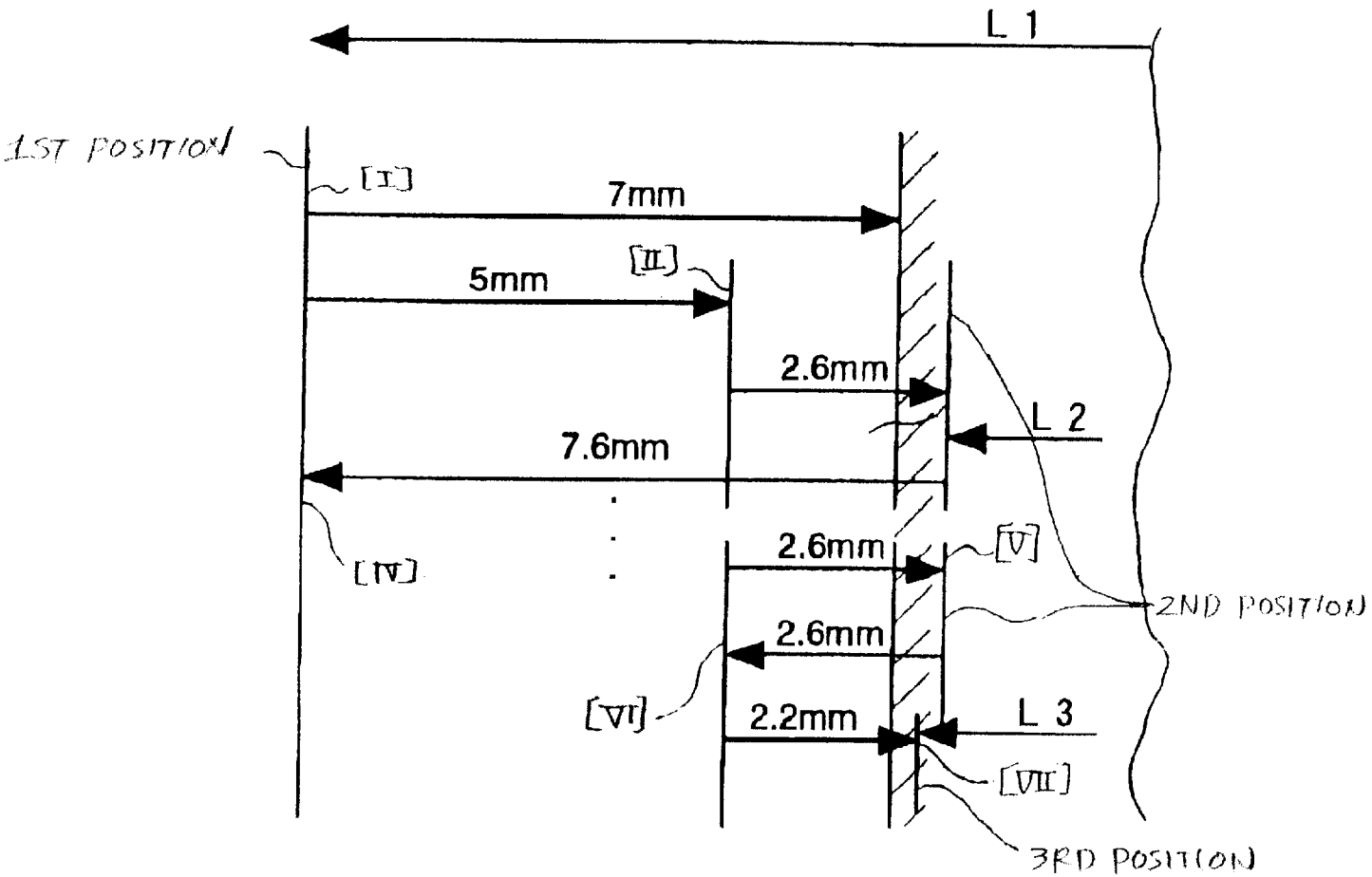
FIG. 9 shows a relation between a first to a third position and the amount of pressing.

A staple mode unique to the illustrative embodiment will be described with reference to FIGS. 3 and 9. As shown in FIG. 9, each jogger fence 9 is moved away from its home position to a first position 7 mm remote from one side of a sheet width and waits for a sheet there ([I]). The conveyance motor 54 drives the lower rollers 4 to thereby convey a sheet entered the finisher. As soon as the trailing edge of the sheet moves away from the sheet sensor 37, the jogger fence 9 jogs 5 mm inward from the first position (stand-by position), as indicated by an arrow ([II]). On sensing the trailing edge of the sheet, the sheet sensor 37 sends its output to the CPU 70. In response, the CPU 70 starts counting pulses output from the conveyance motor 54. On counting a preselected number of pulses, the CPU 70 turns on the solenoid 30. The return roller 5 swings in a pendulum fashion in accordance with the turn-on and turn-off of the solenoid 30. More specifically, when the solenoid 30 is turned on, the return roller 5 hits the sheet to thereby return it downward until the sheet abuts against the rear fences 19, thereby positioning the sheet in the longitudinal direction. Every time the inlet sensor 36 (or the sheet sensor 37) senses a sheet entered the finisher, the CPU 70 counts the sheet.

Figure 8:
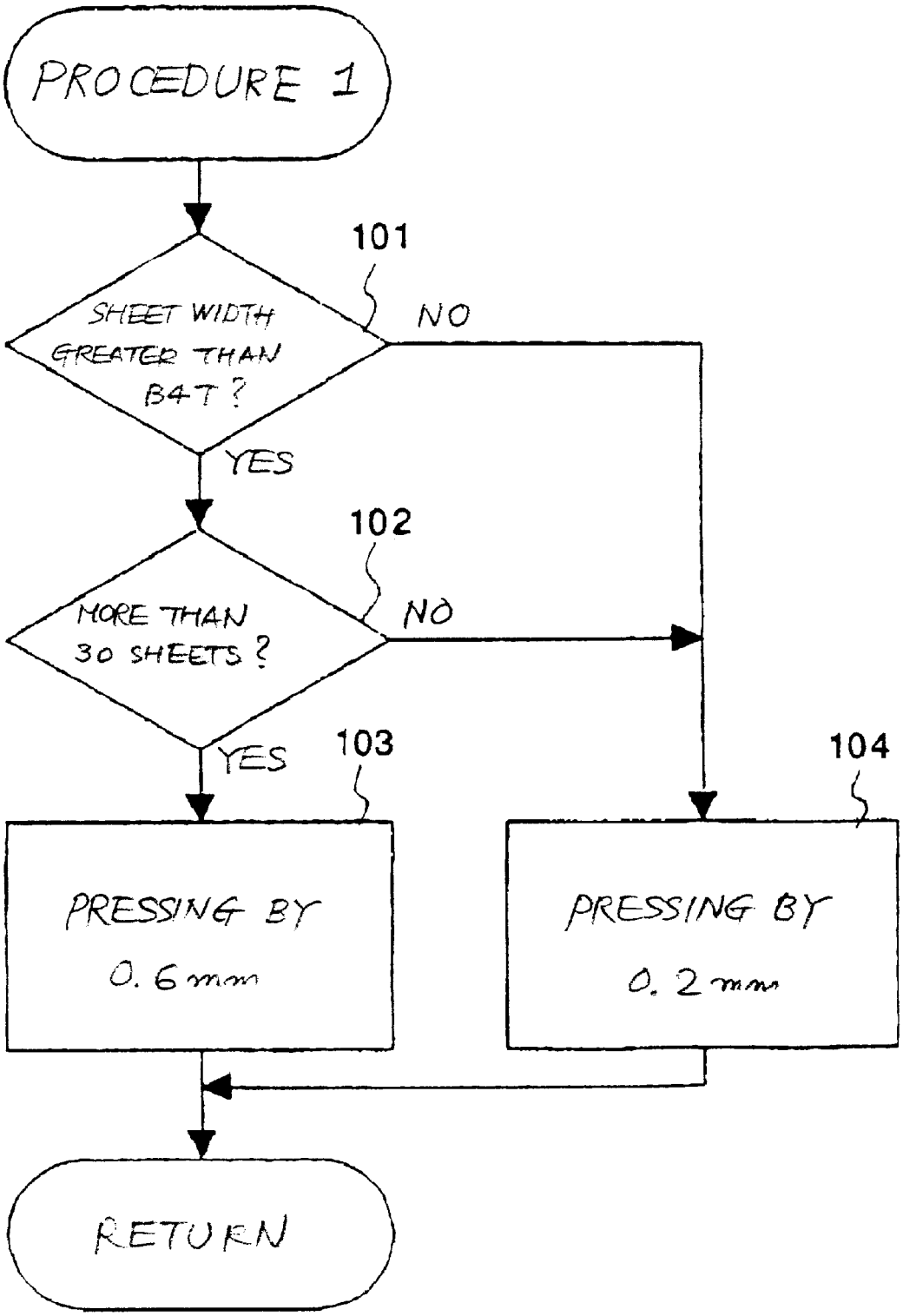
FIG. 8 is a flowchart demonstrating a procedure 1 available with the illustrative embodiment.

On the elapse of a preselected period of time since the turn-off of the solenoid 30, the jogger motor 26 causes the jogger fence 9 to move 2.6 mm inward to a second position, as indicated by an arrow in FIG. 9, and stop there ([III]). As a result, the sheet is positioned in the lateral direction. Subsequently, the jogger fence 9 is returned from the second position to the first position by 7.6 mm so as to wait for the next sheet, as indicated by an arrow in FIG. 9 ([IV]). The jogger fence 9 repeats such a movement up to the last sheet. When the last sheet is introduced into the stapling section 61, the jogger fence 9 moves 2.6 mm inward to the second position, as indicated by an arrow in FIG. 9, and stops there ([V]). Subsequently, the jogger fence 9 again moves 2.6 mm outward, as indicated by an arrow in FIG. 9 ([VI]), and then moves 2.2 mm inward to a third position, as indicated by an arrow in FIG. 9 ([VII]). Consequently, the jogger fences 9 press the opposite side edges of the sheet stack at the third position for thereby preparing the sheet stack for stapling. In FIG. 9, assume that the jogger fences 9 are spaced from each other by a distance of L2 at the second position or by a distance of L3 at the third position FIG. 8 demonstrates a procedure 1 for determining the amount of pressing. As shown, the third position is set in accordance with the width of sheets, as measured in the direction perpendicular to the direction of sheet conveyance and the number of sheets to be stapled together. Also, a service person can change the third position on numeral keys arranged on the copier, as needed. After the jogging of the last sheet, the CPU 70 determines whether or not the width of the sheets is greater than B4T (B4 profile) (step 101). If the answer of the step 101 is YES, then the CPU 70 determines whether or not the number of sheets to be stapled together is greater than thirty (step 102). If the answer of the step 102 is YES, then the CPU 70 causes each jogger fence 9 to move 2.6 mm (7.6 mm inward from the first position), i.e., to press the edge of the sheet stack by 0.6 mm (step 103). On the other hand, if the answer of the step 101 or 102 is NO, then the CPU 70 causes the jogger fence 9 to move 2.2 mm (7.2 mm inward from the first position), i.e., to press the edge of the sheet stack by 0.2 mm (step 104).

It should be noted that the specific numerical values stated above are not theoretical values, but are simply typical values. While the illustrative embodiment varies the third position, the second position may be varied, in which case the third position will be varied relative to the second position.

On the elapse of a preselected period of time, the stapler 11 is driven to staple the stack of sheets. Assume that the operator selects a mode for stapling the sheet stack at a plurality of positions. Then, after stapling the sheet stack at one position, the stapler 11 is moved to another stapling position along the trailing edge of the sheet stack and again staples the sheet stack. After the stapling operation, the belt motor 57 is energized to drive the belt 10. At the same time or on the elapse of a preselected period of time, the discharge motor 55 is energized in order to receive the sheet stack raised by the catch 10*a* of the belt 10.

The jogger fences 9 are controlled in accordance with the sheet size and the number of sheets stapled together. For example, assume that the number of sheets is smaller than preselected one (thirty in the illustrative embodiment) or that the sheet size is smaller than preselected one (B4T in the illustrative embodiment). Then, the jogger fences 9 press the sheet stack whose trailing edge is raised by the catch 10*a*. When a preselected number of pulses are output after the belt home position sensor 39 has sensed the home position of the belt 10, the jogger fences 9 each are retracted by a preselected distance so as to release the sheet stack. The number of the above pulses corresponds to an interval between the time when the catch 10*a* abuts against the trailing edge of the sheet stack and the time when it moves away from the ends of the jogger fences 9. When the number of sheets is greater than preselected one or when the sheet size is greater than preselected one, the jogger fences 9 are retracted by the preselected distance beforehand.

In any case, as soon as the sheet stack moves away from the jogger fences 9, the jogger fences 9 are again moved to the first position or stand-by position to prepare for the next sheet. The procedure described above is repeated up to the last job.

Figure 10:
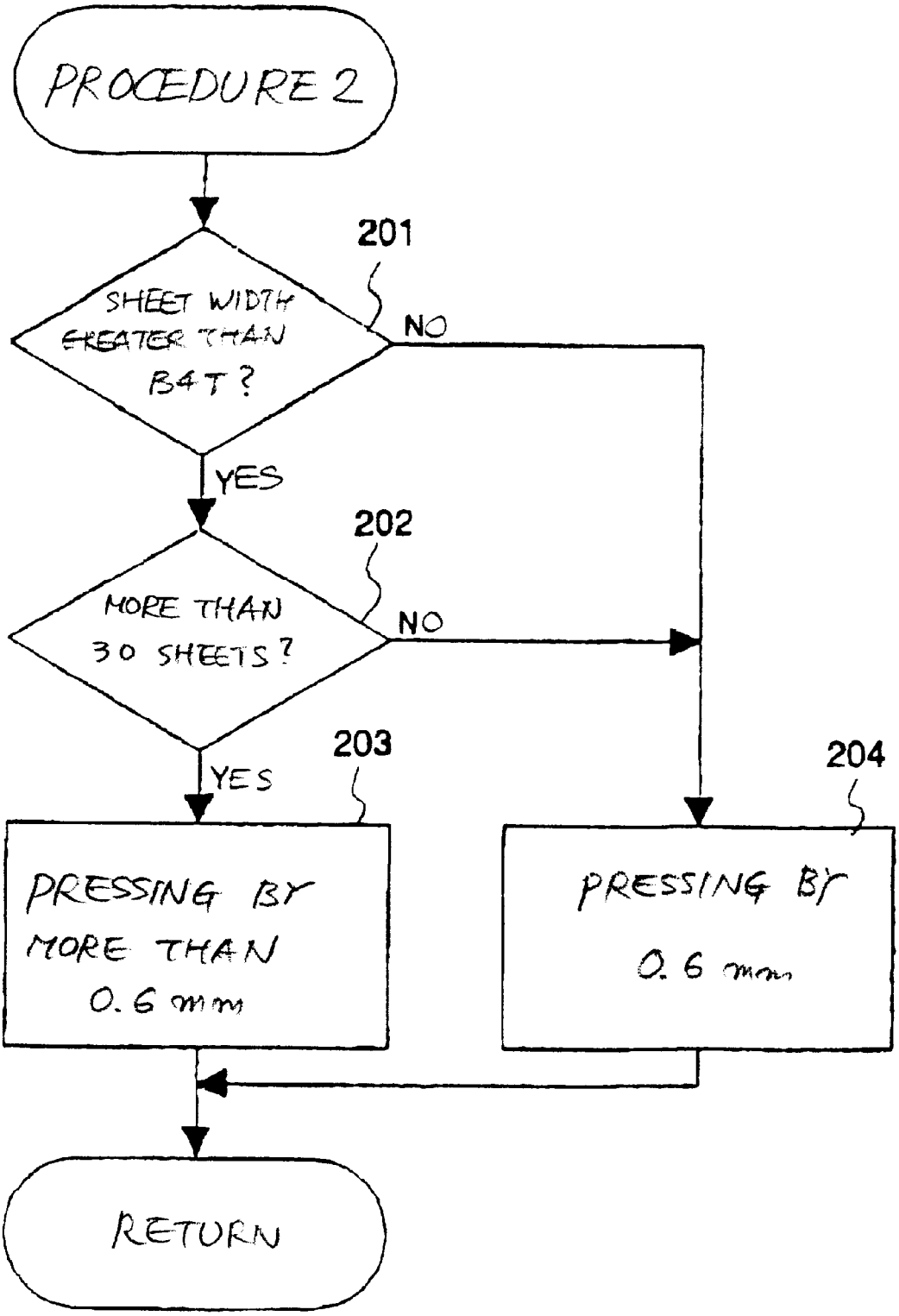
FIG. 10 is a flowchart showing a procedure 2 also available with the illustrative embodiment.

In the illustrative embodiment, each jogger fence 9 presses the sheets by 0.6 mm up to the last sheet. It is sometimes preferable to control the amount of pressing before the last page also, depending on the sheet size and the number of sheets to be stapled together. FIG. 10 shows a procedure 2 for determining the amount of pressing. As shown, assume that the sheet width is smaller than B4T (NO, step 201) or that the sheet width is greater than B4T (YES, step 201), but the number of sheets to be stapled together is less than thirty (NO, step 202). Then, the jogger fences 9 press the sheets preceding the last sheet by 0.6 mm (step 204). If the answers of the steps 201 and 202 both are YES, then the jogger fences 9 press the sheet stack by an amount greater than 0.6 mm, e.g., 0.8 mm to 1.0 mm (step 203). In the illustrative embodiment, the jogger fences 9 have a generally L-shaped cross-section each. Therefore, even when the number of sheets is great and causes the sheet stack to bend relative to the staple tray, the jogger fences 9 prevent the sheet stack from dropping from the staple tray.

In summary, in accordance with the present invention, a sheet finisher allows the second and third positions to be adequately set in accordance with the sheet size and the number of sheets to be stapled together. The finisher can therefore accurately jog sheets without regard to the sheet size. Further, the finisher allows a sheet stack to be surely stapled while guaranteeing high-quality jogging.

Various modifications will become possible for those skilled in the art after receiving the teachings of the present disclosure without departing from the scope thereof.

What is claimed is:

1. A sheet finisher comprising:

stacking means for sequentially stacking sheets thereon;

jogging means for jogging the sheets sequentially stacked on said stacking means one by one; and processing means for executing preselected processing with the sheets;

said jogging means including a pair of jogging members for jogging the sheets one by one; and control means for moving, in accordance with a width of the sheets in a direction perpendicular to a direction of sheet conveyance, each of said pair of jogging members to a first position remote from an edge of said sheets in a direction of the width by a preselected amount, a second position closer to said edge than said first position by a preselected amount and slightly overlapping said edge, and a third position where, when said processing means executes the preselected processing, said jogging member substantially contacts said edge in accordance with said width;

wherein assuming that said pair of jogging members are spaced from each other by a distance of L2 at said second position or by a distance of L3 at said third position, said control means sets at least one of said distances L2 and L3 in accordance with the width of the sheets, and wherein, when said processing means executes the preselected processing, said control means sets said distance of L3 at a lesser distance when the sheets sequentially stacked exceed a determined number, and sets said distance of L3 at a greater distance when the sheets sequentially stacked do not exceed the determined number.

2. The sheet finisher as claimed in claim 1, wherein the preselected processing comprises stapling.

3. The sheet finisher as claimed in claim 1, wherein the distance L2 is smaller than or equal to the distance L3.

4. The sheet finisher as claimed in claim 3, wherein the preselected processing comprises stapling.

5. A sheet finisher comprising:

stacking means for sequentially stacking sheets thereon;

jogging means for jogging the sheets sequentially stacked on said stacking means one by one; and processing means for executing preselected processing with the sheets;

said jogging means including a pair of jogging members for jogging the sheets one by one; and control means for moving, in accordance with a width of the sheets in a direction perpendicular to a direction of sheet conveyance, each of said pair of jogging members to a first position remote from an edge of said sheets in a direction of the width by a preselected amount, a second position closer to said edge than said first position by a preselected amount and slightly overlapping said edge, and a third position where, when said processing means executes the preselected processing, said jogging member substantially contacts said edge in accordance with said width;

wherein assuming that said pair of jogging members are spaced from each other by a distance of L2 at said second position or by a distance of L3 at said third position, said control means sets at least one of said distances L2 and L3 in accordance with a number of the sheets to be stapled together, and wherein, when said processing means executes the preselected processing, said control means sets said distance of L3 at a lesser distance when the sheets sequentially stacked exceed a determined number, and sets said distance of L3 at a greater distance when the sheets sequentially stacked do not exceed the determined number.

6. The sheet finisher as claimed in claim 5, wherein the preselected processing comprises stapling.

7. The sheet finisher as claimed in claim 5, wherein the distance L2 is smaller than or equal to the distance L3.

8. The sheet finisher as claimed in claim 7, wherein the preselected processing comprises stapling.

9. An image forming system comprising:

a sheet finisher; and an image forming apparatus for forming a toner image on a sheet;

said sheet finisher including stacking means for sequentially stacking sheets thereon; jogging means for jogging the sheets sequentially stacked on said stacking means one by one; and processing means for executing preselected processing with the sheets;

said jogging means including a pair of jogging members for jogging the sheets one by one; and control means for moving, in accordance with a width of the sheets in a direction perpendicular to a direction of sheet conveyance, each of said pair of jogging members to a first position remote from an edge of said sheets in a direction of the width by a preselected amount, a second position closer to said edge than said first position by a preselected amount and slightly overlapping said edge, and a third position where, when said processing means executes the preselected processing, said jogging member substantially contacts said edge in accordance with said width;

wherein assuming that said pair of jogging members are spaced from each other by a distance of L2 at said second position or by a distance of L3 at said third position, said control means sets at least one of said distances L2 and L3 in accordance with the width of the sheets, and wherein, when said processing means executes the preselected processing, said control means sets said distance of L3 at a lesser distance when the sheets sequentially stacked exceed a determined number, and sets said distance of L3 at a greater distance when the sheets sequentially stacked do not exceed the determined number.

10. The system as claimed in claim 9, further comprising varying means for varying the distance L2 or L3.

11. The system as claimed in claim 10, wherein said varying means is included in said image forming apparatus.

12. An image forming system comprising:

a sheet finisher; and an image forming apparatus for forming a toner image on a sheet;

said sheet finisher including stacking means for sequentially stacking sheets thereon; jogging means for jogging the sheets sequentially stacked on said stacking means one by one; and processing means for executing preselected processing with the sheets;

said jogging means including a pair of jogging members for jogging the sheets one by one; and control means for moving, in accordance with a width of the sheets in a direction perpendicular to a direction of sheet conveyance, each of said pair of jogging members to a first position remote from an edge of said sheets in a direction of the width by a preselected amount, a second position closer to said edge than said first position by a preselected amount and slightly overlapping said edge, and a third position where, when said processing means executes the preselected processing, said jogging member substantially contacts said edge in accordance with said width;

wherein assuming that said pair of jogging members are spaced from each other by a distance of L2 at said second position or by a distance of L3 at said third position, said control means sets at least one of said distances L2 and L3 in accordance with a number of sheets to be stapled together, and wherein, when said processing means executes the preselected processing, said control means sets said distance of L3 at a lesser distance when the sheets sequentially stacked exceed a determined number, and sets said distance of L3 at a greater distance when the sheets sequentially stacked do not exceed the determined number.

13. The system as claimed in claim 12, further comprising varying means for varying the distance L2 or L3.

14. The system as claimed in claim 13, wherein said varying means is included in said image forming apparatus.

15. A sheet finisher comprising:

a stacking device configured to sequentially stack sheets thereon;

a jogging device configured to jog the sheets sequentially stacked on said stacking device one by one; and a processing device configured to execute preselected processing with the sheets;

said jogging device including a pair of jogging members configured to jog the sheets one by one; and a control device configured to move, in accordance with a width of the sheets in a direction perpendicular to a direction of sheet conveyance, each of said pair of jogging members to a first position remote from an edge of said sheets in a direction of the width by a preselected amount, a second position closer to said edge than said first position by a preselected amount and slightly overlapping said edge, and a third position where, when said processing device executes the preselected processing, said jogging member substantially contacts said edge in accordance with said width;

wherein assuming that said pair of jogging members are spaced from each other by a distance of L2 at said second position or by a distance of L3 at said third position, said control device sets at least one of said distances L2 and L3 in accordance with the width of the sheets, and wherein, when said processing device executes the preselected processing, said control device sets said distance of L3 at a lesser distance when the sheets sequentially stacked exceed a determined number, and sets said distance of L3 at a greater distance when the sheets sequentially stacked do not exceed the determined number.

16. The sheet finisher as claimed in claim 15, wherein the preselected processing comprises stapling.

17. The sheet finisher as claimed in claim 15, wherein the distance L2 is smaller than or equal to the distance L3.

18. The sheet finisher as claimed in claim 17, wherein the preselected processing comprises stapling.

19. A sheet finisher comprising:

a stacking device configured to sequentially stack sheets thereon;

a jogging device configured to jog the sheets sequentially stacked on said stacking device one by one; and a processing device configured to execute preselected processing with the sheets;

said jogging device including a pair of jogging members configured to jog the sheets one by one; and a control device configured to move, in accordance with a width of the sheets in a direction perpendicular to a direction of sheet conveyance, each of said pair of jogging members to a first position remote from an edge of said sheets in a direction of the width by a preselected amount, a second position closer to said edge than said first position by a preselected amount and slightly overlapping said edge, and a third position where, when said processing device executes the preselected processing, said jogging member substantially contacts said edge in accordance with said width;

wherein assuming that said pair of jogging members are spaced from each other by a distance of L2 at said second position or by a distance of L3 at said third position, said control device sets at least one of said distances L2 and L3 in accordance with a number of the sheets to be stapled together, and wherein, when said processing device executes the preselected processing, said control device sets said distance of L3 at a lesser distance when the sheets sequentially stacked exceed a determined number, and sets said distance of L3 at a greater distance when the sheets sequentially stacked do not exceed the determined number.

20. The sheet finisher as claimed in claim 19, wherein the preselected processing comprises stapling.

21. The sheet finisher as claimed in claim 19, wherein the distance L2 is smaller than or equal to the distance L3.

22. The sheet finisher as claimed in claim 21, wherein the preselected processing comprises stapling.

23. An image forming system comprising:

a sheet finisher; and an image forming apparatus for forming a toner image on a sheet;

said sheet finisher including a stacking device configured to sequentially stack sheets thereon; a jogging device configured to jog the sheets sequentially stacked on said stacking device one by one; and a processing device configured to execute preselected processing with the sheets;

said jogging device including a pair of jogging members configured to jog the sheets one by one; and a control device configured to move, in accordance with a width of the sheets in a direction perpendicular to a direction of sheet conveyance, each of said pair of jogging members to a first position remote from an edge of said sheets in a direction of the width by a preselected amount, a second position closer to said edge than said first position by a preselected amount and slightly overlapping said edge, and a third position where, when said processing device executes the preselected processing, said jogging member substantially contacts said edge in accordance with said width;

wherein assuming that said pair of jogging members are spaced from each other by a distance of L2 at said second position or by a distance of L3 at said third position, said control device sets at least one of said distances L2 and L3 in accordance with the width of the sheets, and wherein, when said processing device executes the preselected processing, said control device sets said distance of L3 at a lesser distance when the sheets sequentially stacked exceed a determined number, and sets said distance of L3 at a greater distance when the sheets sequentially stacked do not exceed the determined number.

24. The system as claimed in claim 23, further comprising a varying device configured to varying the distance L2 or L3.

25. The system as claimed in claim 24, wherein said varying means is included in said image forming apparatus.

26. An image forming system comprising:

a sheet finisher; and an image forming apparatus for forming a toner image on a sheet;

said sheet finisher including a stacking device configured to sequentially stack sheets thereon; a jogging device configured to jog the sheets sequentially stacked on said stacking device one by one; and a processing device configured to execute preselected processing with the sheets;

said jogging device including a pair of jogging members configured to jog the sheets one by one; and a control device configured to move, in accordance with a width of the sheets in a direction perpendicular to a direction of sheet conveyance, each of said pair of jogging members to a first position remote from an edge of said sheets in a direction of the width by a preselected amount, a second position closer to said edge than said first position by a preselected amount and slightly overlapping said edge, and a third position where, when said processing device executes the preselected processing, said jogging member substantially contacts said edge in accordance with said width;

wherein assuming that said pair of jogging members are spaced from each other by a distance of L2 at said second position or by a distance of L3 at said third position, said control device sets at least one of said distances L2 and L3 in accordance with a number of sheets to be stapled together, and wherein, when said processing device executes the preselected processing, said control device sets said distance of L3 at a lesser distance when the sheets sequentially stacked exceed a determined number, and sets said distance of L3 at a greater distance when the sheets sequentially stacked do not exceed the determined number.

27. The system as claimed in claim 26, further comprising a varying device configured to varying the distance L2 or L3.

28. The system as claimed in claim 27, wherein said varying means is included in said image forming apparatus.

29. A sheet finisher comprising:

stacking means for sequentially stacking sheets thereon;

contacting means selectively movable into or out of contact with edges of the sheets, which are sequentially stacked on said stacking means one by one, in a direction of a width of said sheets; and processing means for executing preselected processing with the sheets;

said contacting means comprising a pair of contact members and control means for causing, when said processing means executes preselected processing in accordance with the width of the sheets, said pair of contact members to move to a position where said pair of contact members substantially contact the edges of the sheets in accordance with said width;

wherein assuming that said pair of contacting members are spaced from each other by a distance set by said control means in accordance with the width of the sheets, and wherein, when said processing means executes the preselected processing, said control means sets said distance at a lesser distance when the sheets sequentially stacked exceed a determined number, and sets said distance at a greater distance when the sheets sequentially stacked do not exceed the determined number.

30. A sheet finisher comprising:

stacking means for sequentially stacking sheets thereon;

contacting means selectively movable into or out of contact with edges of the sheets, which are sequentially stacked on said stacking means one by one, in a direction of a width of said sheets; and processing means for executing preselected processing with the sheets;

said contacting means comprising a pair of contact members and control means for causing, when said processing means executes preselected processing in accordance with the width of the sheets, said pair of contact members to move to a position where said pair of contact members substantially contact the edges of the sheets in accordance with said width;

wherein assuming that said pair of contacting members are spaced from each other by a distance set by said control means in accordance with a number of the sheets to be stapled together, and wherein, when said processing means executes the preselected processing, said control means sets said distance at a lesser distance when the sheets sequentially stacked exceed a determined number, and sets said distance at a greater distance when the sheets sequentially stacked do not exceed the determined number.

31. An image forming system comprising:

a sheet finisher; and an image forming apparatus for forming a toner image on a sheet;

said sheet finisher including stacking means for sequentially stacking the sheets thereon; contacting means selectively movable into or out of contact with edges of the sheets, which are sequentially stacked on said stacking means one by one, in a direction of a width of said sheets; and processing means for executing preselected processing with the sheets;

said contacting means comprising a pair of contact members and control means for causing, when said processing means executes preselected processing in accordance with the width of the sheets, said pair of contact members to move to a position where said pair of contact members substantially contact the edges of the sheets in accordance with said width;

wherein assuming that said pair of contacting members are spaced from each other by a distance set by said control means in accordance with the width of the sheets, and wherein, when said processing means executes the preselected processing, said control means sets said distance at a lesser distance when the sheets sequentially stacked exceed a determined number, and sets said distance at a greater distance when the sheets sequentially stacked do not exceed the determined number.

32. An image forming system comprising:

a sheet finisher; and an image forming apparatus for forming a toner image on a sheet;

said sheet finisher including stacking means for sequentially stacking the sheets thereon; contacting means selectively movable into or out of contact with edges of the sheets, which are sequentially stacked on said stacking means one by one, in a direction of a width of said sheets; and processing means for executing preselected processing with the sheets;

said contacting means comprising a pair of contact members and control means for causing, when said processing means executes preselected processing in accordance with the width of the sheets, said pair of contact members to move to a position where said pair of contact members substantially contact the edges of the sheets in accordance with said width;

wherein assuming that said pair of contacting members are spaced from each other by a distance set by said control means in accordance with a number of sheets to be stapled together, and wherein, when said processing means executes the preselected processing, said control means sets said distance at a lesser distance when the sheets sequentially stacked exceed a determined number, and sets said distance at a greater distance when the sheets sequentially stacked do not exceed the determined number.

33. A sheet finisher comprising:

a stacking device configured to sequentially stack sheets thereon;

a contacting device selectively movable into or out of contact with edges of the sheets, which are sequentially stacked on said stacking device one by one; and a processing device configured to execute preselected processing with the sheets;

said contacting device comprising a pair of contact members and a control device for causing, when said processing device executes preselected processing in accordance with the width of the sheets, said pair of contact members to move to a position where said pair of contact members substantially contact the edges of the sheets in accordance with said width;

wherein assuming that said pair of contacting members are spaced from each other by a distance set by said control device in accordance with the width of the sheets, and wherein, when said processing device executes the preselected processing, said control device sets said distance at a lesser distance when the sheets sequentially stacked exceed a determined number, and sets said distance at a greater distance when the sheets sequentially stacked do not exceed the determined number.

34. A sheet finisher comprising:

a stacking device configured to sequentially stack sheets thereon;

a contacting device selectively movable into or out of contact with edges of the sheets, which are sequentially stacked on said stacking device one by one; and a processing device configured to execute preselected processing with the sheets;

said contacting device comprising a pair of contact members and a control device for causing, when said processing device executes preselected processing in accordance with the width of the sheets, said pair of contact members to move to a position where said pair of contact members substantially contact the edges of the sheets in accordance with said width;

wherein assuming that said pair of contacting members are spaced from each other by a distance set by said control device in accordance with a number of the sheets to be stapled together, and wherein, when said processing device executes the preselected processing, said control device sets said distance at a lesser distance when the sheets sequentially stacked exceed a determined number, and sets said distance at a greater distance when the sheets sequentially stacked do not exceed the determined number.

35. An image forming system comprising:

a sheet finisher; and an image forming apparatus for forming a toner image on a sheet;

said sheet finisher including a stacking device configured to sequentially stack the sheets thereon; a contacting device selectively movable into or out of contact with edges of the sheets, which are sequentially stacked on said stacking device one by one; and a processing device configured to execute preselected processing with the sheets;

said contacting device comprising a pair of contact members and a control device for causing, when said processing device executes preselected processing in accordance with the width of the sheets, said pair of contact members to move to a position where said pair of contact members substantially contact the edges of the sheets in accordance with said width;

wherein assuming that said pair of contacting members are spaced from each other by a distance set by said control device in accordance with the width of the sheets, and wherein, when said processing device executes the preselected processing, said control device sets said distance at a lesser distance when the sheets sequentially stacked exceed a determined number, and sets said distance at a greater distance when the sheets sequentially stacked do not exceed the determined number.

36. An image forming system comprising:

a sheet finisher; and an image forming apparatus for forming a toner image on a sheet;

said sheet finisher including a stacking device configured to sequentially stack the sheets thereon; a contacting device selectively movable into or out of contact with edges of the sheets, which are sequentially stacked on said stacking device one by one; and a processing device configured to execute preselected processing with the sheets;

said contacting device comprising a pair of contact members and a control device for causing, when said processing device executes preselected processing in accordance with the width of the sheets, said pair of contact members to move to a position where said pair of contact members substantially contact the edges of the sheets in accordance with said width;

wherein assuming that said pair of contacting members are spaced from each other by a distance set by said control device in accordance with a number of sheets to be stapled together, and wherein, when said processing device executes the preselected processing, said control device sets said distance at a lesser distance when the sheets sequentially stacked exceed a determined number, and sets said distance at a greater distance when the sheets sequentially stacked do not exceed the determined number.

* * * * *

UNITED STATES PATENT AND TRADEMARK OFFICE

CERTIFICATE OF CORRECTION

PATENT NO. : 6,698,744 B2
DATED : March 2, 2004
INVENTOR(S) : Yamada et al.

It is certified that error appears in the above-identified patent and that said Letters Patent is hereby corrected as shown below:

Title page,
Item [75], Inventors should read:
-- [75] Inventors: Kenji Yamada, Tokyo (JP); Shinji Asami, Saitama (JP); Nobuyoshi Suzuki, Tokyo (JP); Hiromoto Saitoh, Kanagawa (JP); Takeshi Sasaki, Tokyo (JP); Hiroki Okada, Kanagawa (JP); Junichi Iida, Kanagawa (JP) --

Signed and Sealed this

Eighteenth Day of May, 2004

JON W. DUDAS
*Acting Director of the United States Patent and Trademark Office*